US005396270A

United States Patent [19]

Gooray et al.

[11] Patent Number: 5,396,270

[45] Date of Patent: Mar. 7, 1995

[54] WET PAPER HANDLING OF INK JET IMAGES TO ALLOW PASSIVE DRYING

[75] Inventors: Arthur M. Gooray; Kenneth C. Peter, both of Penfield; Wayne D. Drinkwater, Fairport, all of N.Y.

[73] Assignee: Xerox Corporation, Stamford, Conn.

[21] Appl. No.: 974,015

[22] Filed: Nov. 10, 1992

[51] Int. Cl.[6] ..... B41J 13/08; B41J 2/01; B41F 21/00; B65H 31/00

[52] U.S. Cl. ..... 346/25; 346/134; 347/102; 101/424.1; 271/209; 400/625; 198/801

[58] Field of Search ..... 346/1.1, 25, 134, 140 R; 271/287, 288, 296–298, 300, 182, 188, 207, 209, 220, 223; 101/424.1, 488; 400/625; 347/102; 198/801, 347.3; 34/611, 612

[56] References Cited

U.S. PATENT DOCUMENTS

| | | | |
|---|---|---|---|
| 2,306,607 | 12/1937 | Horton | 34/23 |
| 4,058,908 | 11/1977 | Weber | 198/801 X |
| 4,469,026 | 9/1984 | Irwin | 346/25 X |
| 4,505,375 | 3/1985 | Kuster | 198/801 X |
| 4,728,963 | 3/1988 | Rasmussen et al. | 346/25 |
| 4,970,528 | 11/1990 | Beaufort et al. | 346/25 |
| 4,982,207 | 1/1991 | Tunmore et al. | 346/138 |
| 5,244,294 | 9/1993 | Ewing | 400/625 |
| 5,299,875 | 4/1994 | Hock et al. | 400/625 |

FOREIGN PATENT DOCUMENTS

| | | | |
|---|---|---|---|
| 3633808 | 7/1987 | Germany | 101/424.1 |
| 2-47681 | 2/1990 | Japan . | |

*Primary Examiner*—Benjamin R. Fuller
*Assistant Examiner*—Alrick Bobb
*Attorney, Agent, or Firm*—Oliff & Berridge

[57] ABSTRACT

An ink jet printer has a sheet conveying and drying device having a plurality of flexible, resilient yet stiff fingers connected in a cantilevered manner to a drive chain which moves the fingers from a printed sheet receiving tray to a sheet stacking tray. After sheets are printed by a conventional ink jet printing head, the sheets are picked off of the printed sheet receiving tray and fed to a sheet stacking tray. The printed sheets are dried while being fed from the printed sheet receiving tray to the sheet stacking tray. After the printed sheets are picked off of the fingers at the sheet stacking tray, the chain drive continues to move the fingers in a counterclockwise direction along the chain path. The resilient, flexible fingers are deformed by upper and lower guide rollers, a stacking tray and a rear separating wall and are flicked back into a sheet receiving position at the printed sheet receiving tray. The speed at which the chain drive moves the fingers can be varied to ensure that the images are dried by the time they reach the sheet stacking tray.

21 Claims, 4 Drawing Sheets

WET PAPER HANDLING OF INK JET IMAGES TO ALLOW PASSIVE DRYING

BACKGROUND OF THE INVENTION

1. Field of the Invention

The present invention relates to a method and apparatus for handling and drying sheets which contain wet ink jet images. More specifically, the invention relates to an apparatus for passively drying printed sheets and sequentially stacking the dried printed sheets.

2. Description of the Related Art

Ink jet printing demands that excess moisture (generally water) on the surface of printed sheets be removed within a set time period and before the sheets are stacked. If the sheets are stacked before the images are dry, image smearing and offset occur.

Devices that actively remove moisture, specifically water, from the sheet surface are referred to as dryers. A commonly used dryer is a hot air convective mass transfer drying system. While dryers are effective in rapidly removing the excess moisture from the sheets, dryers greatly increase printer power requirements and size. If dryers were used in small printers, the size and cost of these printers would greatly increase. Also, most small printers do not have the power capacity to accommodate an active dyer.

U.S. Pat. No. 4,970,528 to Beaufort et al. discloses an ink jet printing apparatus having a uniform heat flux dryer system which uses an infrared bulb and reflectors to transmit heat to the printed paper during the ink drying process. The freshly printed sheet is dried as it is fed from the printing apparatus along a 180° arc which surrounds the infrared bulb and reflectors.

U.S. Pat. No. 4,982,207 to Tunmore et al. discloses an ink jet printer having a rotary platen with a heater contained therein. The platen is made of a heat conducting material to transmit the heat from the heater unit enclosed therein to the outer surface of the platen to dry the printed sheet before it is fed to a stacking unit.

U.S. Pat. No. 2,306,607 to Horton discloses a web drying device for sheets printed by an intaglio printing apparatus. The web drying device feeds the web along a series of rollers while exposing the web to heat blown onto the web by an exhaust fan.

The prior art references all teach the use of some type of active heating element to dry the freshly printed sheets. As discussed above, these active dryers demand increased printer power capacity and also increase the size and cost of the printing apparatus which is unacceptable for a small, relatively inexpensive printer. Thus, these small printers must rely on passive drying systems to dry the wet sheets to maintain their low cost. However, most passive drying systems require large areas to avoid wet sheets from contacting any surface which will cause smearing and therefore, greatly increase the size of the printer.

None of these references provides a passive dryer for small printers which dries ink jet printed sheets while the sheets are fed from the printing apparatus to a stacking tray.

OBJECTS AND SUMMARY OF THE INVENTION

It is an object of the present invention to provide a passive drying system for an ink jet printer to efficiently dry sheets having wet printed images without increasing the size and cost of the printer.

It is also an object of the present invention to provide an apparatus for transporting wet sheets which allows passive drying of the wet sheets without requiring an increased printer power capacity.

It is another object of the present invention to provide a wet sheet handling and drying device which varies the transporting time of the wet sheets to ensure that the images contained thereon are dried before stacking the sheets.

The present invention is usable with small ink jet printers with relatively small power capacity. The sheet drying and transporting apparatus of the present invention does not significantly increase the overall size of the printer as only the height of the printer is increased by a very small amount. No active dryer is required by the wet sheet handling and drying apparatus of the present invention. The power required to drive the wet sheet handling and drying apparatus of the present invention is well within the power capacity of a conventional small ink jet printer.

However, if a faster sheet throughput is desired, a supplemental active dryer can be used. For example, hot air can be blown on the wet printed sheets while they are being transported from the printhead to a stacking tray.

The ink jet printhead for use in this invention is a conventional reciprocating carriage type which prints images while moving bidirectionally. After a sheet has been printed by the ink jet printhead, the sheet is pushed onto a printed sheet receiving tray. The printed sheet receiving tray forms a shelf which holds the freshly printed sheets and contains several spaced, longitudinally extending slots, each having a plastic finger recessed therein. The fingers are connected to an endless chain drive mechanism which moves the fingers upward out of the slots, thereby lifting and removing the printed sheet from the tray. The fingers are laterally aligned and form a support shelf for transporting a sheet to a stacking tray. There are a plurality of support shelves formed by fingers connected along the chain of the drive mechanism. Thus, another shelf of fingers will be positioned to pick-up the next sheet output from the printhead to the printed sheet receiving tray.

The printed sheets are transported upwardly by the support shelf fingers until they are dried under ambient conditions. As some inks dry more slowly than others and some paper absorbs ink at a slower rate than others, the speed of the finger drive mechanism is controlled according to the ambient drying requirements of the particular ink and sheets being used to ensure that the images are dried before stacking. The shelves are exposed so that an operator can easily view the freshly printed sheets as they are being moved upwardly by the fingers. Thus, the operator can proof the printed images before the images dry and before they are stacked in a stacking tray. By the time the sheets reach the top of the finger drive path, the sheets are dry. Then the sheets and fingers are guided around the top of the sheet handling apparatus by guiding rollers. As the fingers are flexible, the fingers containing the sheets are bent back and compressed together. The fingers and sheets held therebetween move downward toward a stacking tray. A segmented lip on the stacking tray has cutouts or recesses which the fingers pass through as the fingers travel past the stacking tray. When the fingers engage the recesses of the segmented lip of the stacking tray, the segmented lip picks each dried sheet sequentially from the fingers and the sheets are stacked in the stacking tray face down.

The fingers which form the shelves for the printed sheets are connected to connecting rods on the chain drive mechanism in a cantilevered fashion. The connecting rods are biased by torsion springs which allow the rods to rotate with respect to the chain drive mechanism while moving along the transport path. The fingers are sufficiently stiff to hold a sheet but are also flexible and resilient so that they can be bent by the stacking tray, a separating wall and guiding rollers while returning to the tray to pick up additional sheets. The fingers are deformed by the stacking tray, and after clearing the tray, the fingers are flipped by lower guide rollers and a rear separating wall into a printed sheet receiving position under the printed sheet receiving tray to pick up another sheet. A vibration damping material is provided to contact the fingers after they are flipped. The damping material dampens excessive finger motion to reduce noise and ensure that the fingers are properly positioned within the printed sheet receiving tray. The guide rollers also function to ensure that the fingers do not become jammed or damaged while moving within the separating wall and stacking tray and flipped into the sheet receiving position. In using deformable flexible fingers, the size of the paper transport and drying apparatus can be kept small as the fingers can bend and fit into small areas.

As mentioned previously, if faster throughput of the sheets is desired, hot air can be blown in between the shelves to ensure that the images are dry before reaching the stacking tray.

BRIEF DESCRIPTION OF THE DRAWINGS

The invention will be described in detail with reference to the following drawings wherein.

DETAILED DESCRIPTION OF PREFERRED EMBODIMENTS

Figure 1:
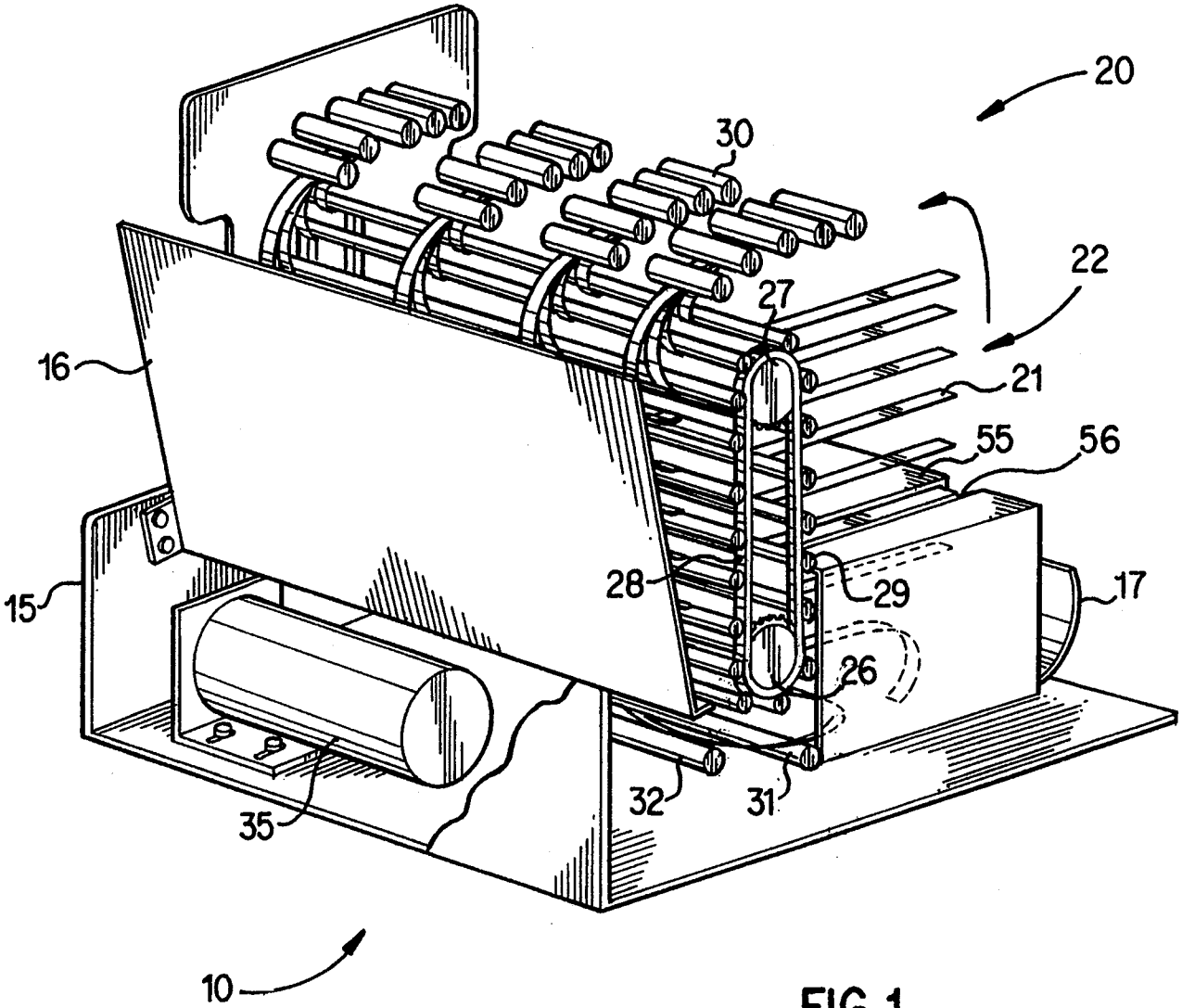
FIG. 1 is a schematic perspective view of an ink jet printer having a paper handling apparatus of the present invention.
Figure 2:
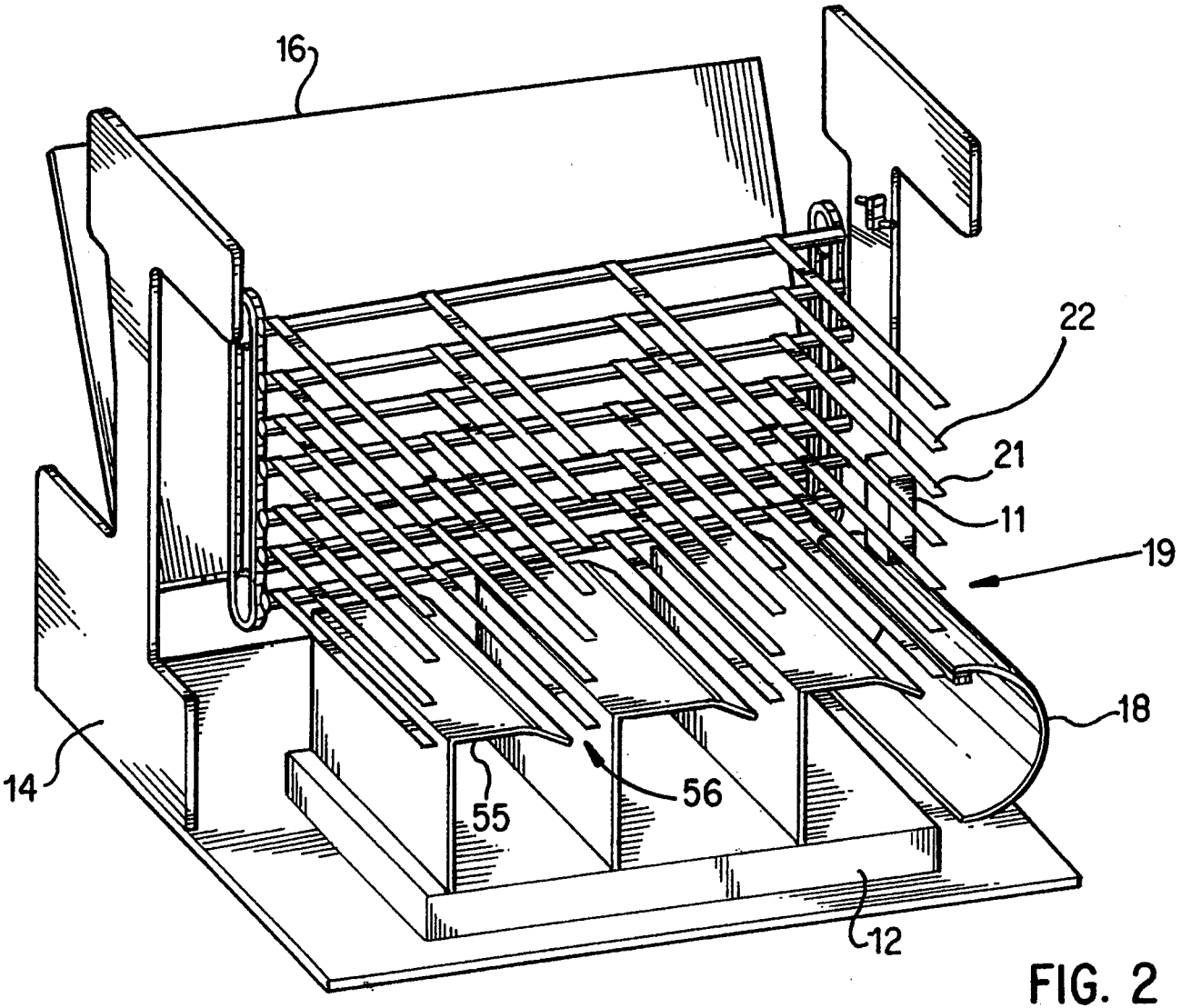
FIG. 2 is a schematic partial perspective rear view of FIG. 1 showing the feeding unit and the printhead.
Figure 4:
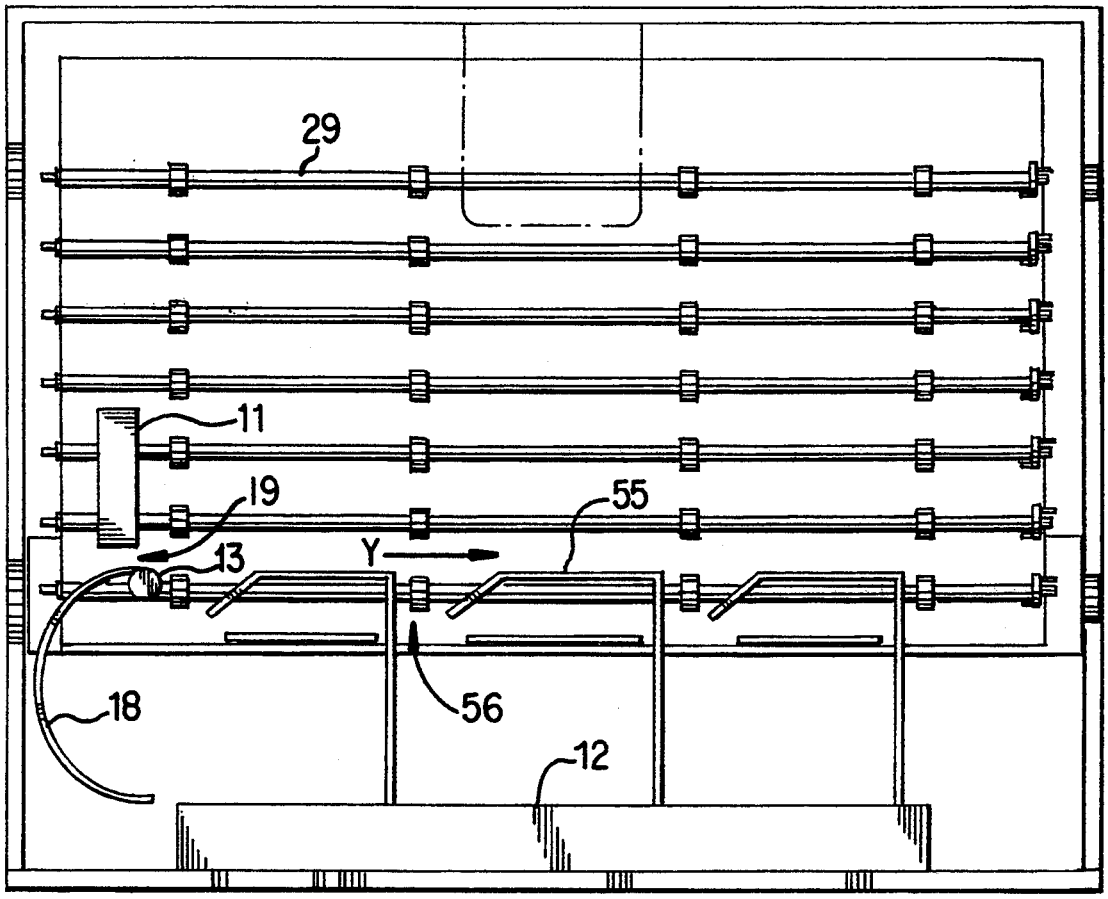
FIG. 4 is a front elevation view of FIG. 1 with the chain drive motor and stacking tray removed.

FIGS. 1 and 2 show an ink jet printer 10, having a conventional ink jet printhead 11 in a printing area 19. The printer has a supply tray 12 and a conventional sheet feeding mechanism (not shown) which removes one sheet at a time from supply tray 12 and feeds the sheets along a sheet input path 18 to printhead 11 by way of a sheet kicker 13 shown in FIG. 4. Sheet kicker 13 may be a friction drive roller or a gripper roller. Sheet kicker 13 as shown in FIG. 4 is a friction drive roller which uses a high friction surface to drive the leading edge of a sheet to be printed and feed the sheet in the direction of arrow Y in FIG. 4. Attached to printer 10, is a sheet conveying and drying apparatus 20 of the present invention.

Figure 3:
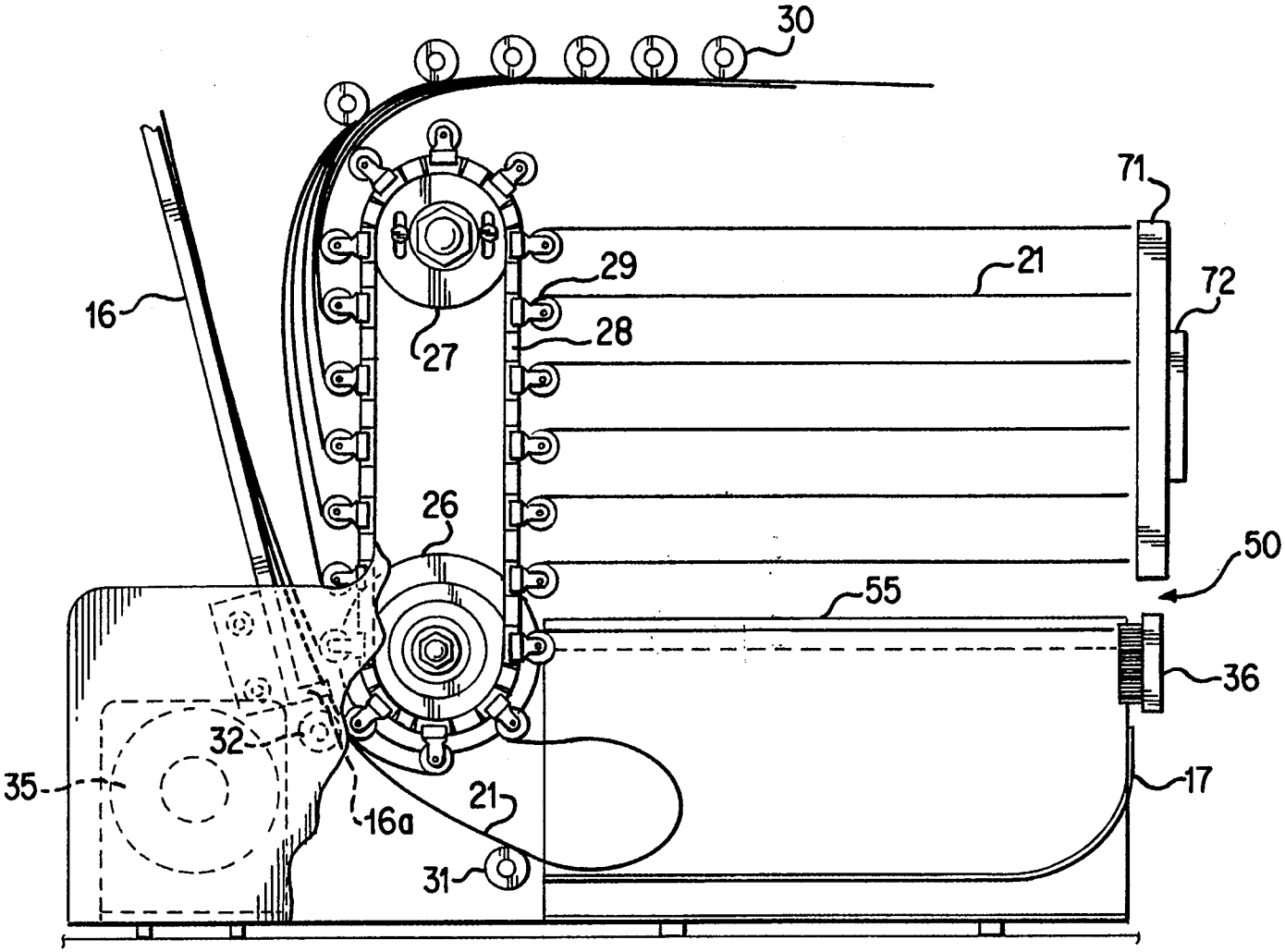
FIG. 3 is a side elevation view of FIG. 1 showing the chain drive assembly and stacking tray.

Sheet conveying and drying device 20, has a plurality of shelves 22 formed by a plurality of fingers 21. Fingers 21 are designed to be resilient, flexible and deformable while having sufficient strength and stiffness to hold and transport sheets. Fingers 21 are preferably made of plastic but could also be formed of sheet metal or other similar materials exhibiting the above properties. Sheet conveying and drying apparatus 20 also has upper guiding rollers 30 located at the top of apparatus 20. As shown in FIG. 3, rollers 30 guide the sheets being carried by fingers 21 and deform fingers 21 so that the size of the printer can be kept small.

As shown in FIG. 2, there are preferably four fingers 21 provided for each shelf. The number of fingers per shelf may be varied according to the size of the printer, the size of the sheets being printed, and the weight of the sheets being printed. Also, the number of shelves can be varied according to the drying characteristics of the particular ink being used, paper used and image printed.

Fingers 21 are attached in a cantilevered fashion to connecting rods 29 located on a pair of chains 28, one chain being provided on each side of sheet conveying and drying apparatus 20. Connecting rods 29 have torsion springs allowing rods 29 to rotate about 90° in the clockwise direction, as viewed in FIG. 3, when fingers 21 are bent by upper guide rollers 30 which reduces bending stress on fingers 21. Chains 28 are attached to drive pulleys 26 and 27 located on both upper and lower sides of sheet conveying and drying apparatus 20. Pulleys 26, 27 are driven by a pulley drive motor 35. Pulley drive motor 35 is a stepper motor controlled by a CPU (not shown) which can control the starting, stopping and speed at which the pulleys are rotated. Motor 35 drives pulley 26 through a conventional chain drive (not shown).

Figure 5:
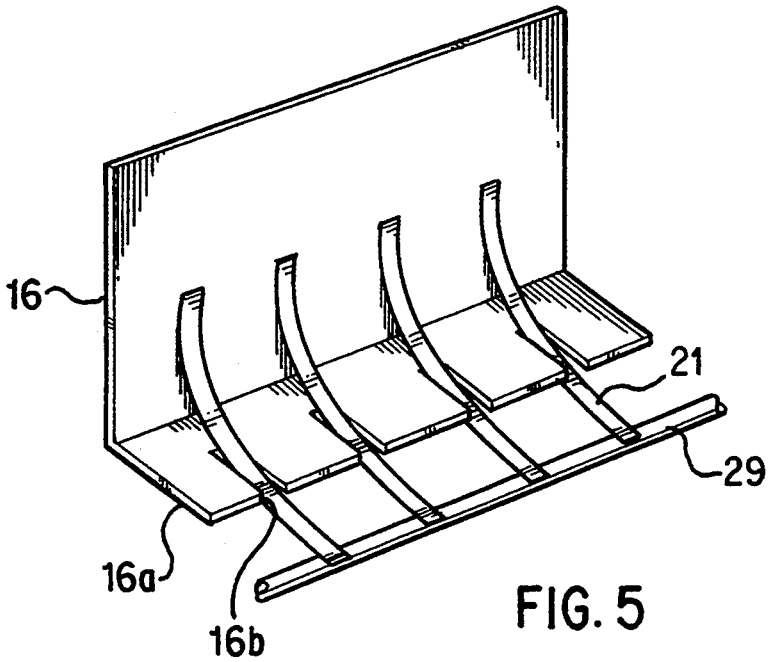
FIG. 5 is a schematic perspective view of the stacking tray.

The printer housing as shown in FIGS. 1 and 3, includes sidewalls 14 and 15 and a stacking tray 16. As fingers 21 move within sidewalls 14, 15 toward stacking tray 16, fingers 21 are released from rollers 30, thereby separating and projecting the fingers towards stacking tray 16. Stacking tray 16 has a segmented lip or projection **16*a* shown in FIG. 5, which removes the sheets from fingers 21 and stacks the sheets in stacking tray 16. As seen in FIG. 5, fingers 21 fit into recesses or grooves 16*b* in segmented lip 16*a* of stacking tray 16. As fingers 21 contact recesses 16*b*, the sheets are picked off fingers 21 by segmented lip 16*a* and deposited face down in stacking tray 16. The order in which the sheets are stacked is 1 to N. A rear arcuate separating wall 17 and lower guide rollers 31, 32 are provided at the bottom of the printer. Upper guide rollers 30, stacking tray 16, lower guide rollers 31, 32 and rear separating wall 17 define the path of travel of fingers 21. These walls and rollers deform fingers 21 as the fingers move from the printed sheet receiving area 50 to stacking tray 16 and back to printed sheet receiving area 50. Guide rollers 31, 32 are driven by a drive means (not shown) at a speed faster than the chain speed to flip the fingers back into a sheet receiving position at printed sheet receiving area 50. Rear separating wall 17 also helps flip fingers 21 back into a sheet receiving position. A damping member 36 located above rear separating wall 17 dampens vibration in fingers 21 caused by flipping fingers 21 back into a sheet receiving position. Upper and lower guide rollers 30, 31, 32 ensure that fingers 21 do not become jammed or damaged while being forced around stacking tray 16 and separating wall 17 and flipped into sheet receiving position. After being released from rear separating wall 17, the torsion springs on connecting rods 29** urge fingers 21 to rotate back to their original orientation.

Printed sheet receiving area 50 has a printed sheet receiving tray 55 which receives the sheets from printhead 11. Sheet receiving tray 55 has a plurality of slots 56 to accommodate fingers 21 therein. The number of slots 56 can be varied according to the number of fingers 21.

The operation of the invention will now be described. As shown in FIGS. 2 and 4, a sheet is fed from supply tray 12 along a sheet input path 18 to printing area 19. Ink jet printhead 11 then prints the sheet in a conventional manner. The sheet is fed by sheet kicker 13 which feeds the sheet in the direction of arrow Y as shown in FIG. 4.

After printing is completed, the sheet is fed by sheet kicker 13 to printed sheet receiving tray 55 in printed sheet receiving area 50. Then a CPU sends a signal to activate pulley drive motor 35. Pulley drive motor 35 is activated to drive pulleys 26, 27 in a counterclockwise direction. This movement causes chain 28 to travel around pulleys 26 and 27 and fingers 21 to be indexed in an upward direction. The speed of pulley drive motor 35 is controlled by the CPU in accordance with a throughput speed selected by the operator or determined by the CPU according to the type of paper and ink being used. The operator selects a speed so that the sheets are dried under ambient conditions or the operator inputs information on the type of ink, ink area coverage and paper being used so that the CPU determines the proper finger travel speed using a look-up table.

By the time fingers 21 and the sheet being carried thereon reach upper guide rollers 30 at the top of the chain drive path, the sheet is dry. As shown in FIG. 3, upper guide rollers 30 deform fingers 21 supporting the dried sheets to prepare the sheets for stacking causing connecting rods 29 to rotate. As shown in FIG. 3, rods 29 on the printed sheet receiving tray side of the chain drive assembly rotate about 90° with respect to rods 29 on the stacking tray side of the chain drive assembly. The natural force of the torsion springs in rods 29 cause rods 29 to rotate counterclockwise back to their original position when fingers 21 are released from guide rollers 31 and rear separating wall 17. The fingers travel downward from the upper guide rollers 30 to the stacking tray 16. As fingers 21 move past rollers 30, fingers 21 are flipped by rollers 30 against stacking tray 16 and the sheets are compressed between surrounding fingers 21 during the downward movement. As fingers 21 containing a printed sheet pass against segmented lip **16*a* of stacking tray 16, the sheet is picked off of fingers 21 and deposited face down in 1 to N order in stacking tray 16. Fingers 21 continue rotating along the chain drive path in the counterclockwise direction. Fingers 21, being sufficiently resilient and flexible, are bent by lower guide rollers 31, 32 and rear separating wall 17. Guide rollers 31, 32 are driven faster than the speed of the chain to snap the fingers back to their original outwardly extending form. Rollers 31, 32 and rear separating wall 17 flip the fingers to damping member 36 to dampen vibration and prevent noise and back into position within slots 56 in bottom tray 55 as shown in FIGS. 1 and 3. Thus, fingers 21 are ready to pickup the next printed sheet and carry it past guide rollers 30 to deposit the sheet in sheet stacking tray 16**.

The operation of the CPU and stepper motor 35 is as follows. The CPU receives a print signal and determines the number of sheets to be printed. If the CPU determines that the number of sheets to be printed is equal to or greater than the number of shelves 22, the CPU signals the chain drive motor to drive the fingers in a normal one step indexing mode. In the normal indexing mode, fingers 21 are indexed one step after each sheet is printed. The indexing of one step results in fingers 21 containing the sheet just printed being moved upwardly by one shelf position and the next shelf being positioned within slots 56 of printed sheet receiving tray 55 to receive the next printed sheet. The one step indexing of the fingers continues until the CPU determines that the last printed sheet is deposited in the printed sheet receiving tray. As there are no more sheets to be printed at this point, the CPU actuates an override mode which indexes fingers 21 without having to wait for the next sheet to be printed as in the normal indexing mode. The CPU controls the speed at which fingers 21 are driven in the override mode depending on the type of ink, type of sheet and amount of ink area coverage to ensure that the sheets are dry before they reach upper guide rollers 30. The CPU causes drive motor 35 to stop driving fingers 21 when all of the printed sheets have been deposited in sheet stacking tray 16.

This override mode can also be used where only a few sheets are printed. For example, if only three sheets are to be printed, the CPU controls the paper sheet feeding mechanism and finger drive motor 35 to index fingers 21 one step after each page is printed. After all three sheets have been printed, the CPU sends an override mode signal to chain drive motor 35 to continuously index fingers 21 without stopping to print another sheet. The CPU drives fingers 21 in the override mode at a speed sufficient to dry the sheets before they reach upper guiding rollers 30 as described above.

An alternative embodiment of the invention is to add a supplemental dryer as shown in FIG. 3. If faster throughput of the sheets is desired, hot air can be blown between shelves 22. This is accomplished by attaching a separate heating unit 70 with an exhaust manifold 71 which blows heated air to the printed sheets on shelves 22. It is also contemplated that any common type of dryer for drying printed sheets can be attached to the printer. Examples of such common types include convective or radiant dryers.

The invention has been described with reference to the preferred embodiments thereof, which are illustrative and not limiting. Various changes may be made without departing from the spirit and scope of the invention as defined in the appended claims.

What is claimed is:

1. An apparatus for handling and drying wet printed sheets comprising:

printed sheet receiving tray means located at a first end of a paper conveying path for receiving wet printed sheets;

a sheet stacking tray located at a second end of the paper conveying path for receiving and stacking dried printed sheets;

a plurality of resilient, deformable fingers movable along the paper conveying path between the first end and the second end of the paper conveying path for conveying wet printed sheets in a conveying direction along the paper conveying path from said printed sheet receiving tray to said sheet stacking tray while drying the wet printed sheets under ambient conditions and for stacking the dried printed sheets in said sheet stacking tray;

an upper guide device located upstream of said sheet stacking tray in the conveying direction, the upper guide device deforming the fingers into a sheet stacking position adjacent the sheet stacking tray; and a lower guide device located downstream of the sheet stacking tray in the conveying direction, the lower guide device guiding the fingers to flip from the sheet stacking position into a sheet receiving position adjacent the printed sheet receiving tray means.

2. The handling and drying apparatus of claim 1, wherein said resilient, deformable fingers convey the printed sheets one at a time.

3. The handling and drying apparatus of claim 2, wherein said printed sheet receiving tray has a plurality of slots formed therein, and further comprising sheet feeding means for feeding a printed sheet from a printing mechanism to said printed sheet receiving tray so that the printed sheet rests on said printed sheet receiving tray and said plurality of fingers pass through said slots and lift the sheet to convey the sheet to said sheet stacking tray.

4. The handling and drying device of claim 1, further comprising a housing supporting said plurality of fingers, wherein said printed sheet receiving tray is located on one side of the plurality of fingers in said housing and said stacking tray is located on the other side of said plurality of fingers in said housing.

5. The handling and drying apparatus of claim 4, wherein the upper guide device comprises a plurality of upper guide rollers and the lower guide device comprises a plurality of driven lower guide rollers, wherein said path of the sheets extends from said printed sheet receiving tray, under said upper guide rollers, and to said sheet stacking tray.

6. The handling and drying apparatus of claim 5, further comprising an arcuate separating wall located in said housing between said lower guide rollers and said sheet receiving tray, wherein said fingers are driven from said lower guide rollers in a deflected state against said separating wall to an extended state.

7. The handling and drying apparatus of claim 1, further comprising a control means for controlling the speed at which said fingers cover the sheets along said path in order to allow sufficient time for ambient drying.

8. The handling and drying apparatus of claim 1, wherein said plurality of fingers has at least one endless conveying device, a pair of pulleys supporting said at least one endless conveying device, and a pulley drive motor, wherein said pulley drive motor drives one of said pulleys to drive said at least one endless conveying device.

9. The handling and drying apparatus of claim 8, wherein said fingers are secured to said endless member by finger connecting rods in a cantilevered manner, each of said connecting rods having a torsion spring for allowing the rods to rotate when said fingers are deformed by said upper guide rollers

10. The handling and drying apparatus of claim 8, wherein said pulley drive motor comprises a stepper motor.

11. The handling and drying means of claim 1, further comprising a blower means located proximate said plurality of fingers for blowing hot air on the wet printed sheets.

12. The handling and drying apparatus of claim 1, wherein said sheet stacking tray comprises a grooved projection extending therefrom for picking dried sheets from said plurality of fingers.

13. The handling and drying apparatus of claim 12, wherein said grooved projection has a plurality of grooves and projecting members spaced by said grooves, wherein said fingers pass through said grooves to allow said projecting members to remove the sheets from said fingers and stack the sheets in 1 to N order in said stacking tray.

14. A method of handling and drying wet, printed sheets in an ink jet printer having an upper guide device and a lower guide device, the method comprising the steps of:

feeding a plurality of sheets sequentially from a sheet supply tray to a sheet printing area;

printing an image on each of the sheets in the sheet printing area to form wet printed sheets;

sequentially feeding each of the wet printed sheets from the sheet printing area to a printed sheet receiving tray to locate a first one of the wet printed sheets on a plurality of fingers positioned at the printed sheet receiving tray;

moving the fingers in a conveying direction to pick up the first one of the wet printed sheets and convey the first one of the wet printed sheets towards a sheet stacking tray;

indexing the fingers in a stepping manner to position an empty shelf of the fingers at the printed sheet receiving tray to receive subsequent ones of the printed sheets;

drying the wet printed sheets under ambient conditions while conveying the wet printed sheets toward the sheet stacking tray, the wet printed sheets becoming dried printed sheets;

feeding the fingers and the dried printed sheets into contact with the upper guide device thereby deforming the fingers;

feeding the fingers past the sheet stacking tray; and picking the dried printed sheets off of the fingers and stacking the dried printed sheets in the sheet stacking tray.

15. The method of claim 14, further comprising the step of:

moving the fingers in an override mode when all of the sheets have been printed so that the fingers do not pause to pick up any more sheets.

16. The method of claim 15, wherein the upper guide device comprises a plurality of upper guide rollers and the lower guide device comprises a plurality of lower guide rollers, further comprising the step of guiding the fingers past the lower guide rollers and driving the lower guide rollers to flip the fingers back into a sheet receiving position at the printed sheet receiving area.

17. The method of claim 15, further comprising a step of controlling the speed at which the fingers are fed according to a speed selected by the operator.

18. The method of claim 15, further comprising the step of controlling a speed at which the fingers are fed according to a type of paper and ink being used.

19. An ink jet printing apparatus comprising:

an ink jet printhead for forming images on sheets;

sheet feeding means for feeding a sheet past the printhead to create wet printed sheets;

printed sheet receiving tray means for receiving the wet printed sheets fed past said printhead by the sheet feeding means;

a sheet stacking tray located downstream of the printed sheet receiving tray in a conveying direction of the wet printed sheets; and a plurality of resilient, deformable fingers movable along the paper conveying path secured to an endless conveying device for ambiently drying the wet printed sheets printed by said ink jet printhead while conveying the sheets in a conveying direction from said printed sheet receiving tray to said sheet stacking tray;

an upper guide device located upstream of the sheet stacking tray in the conveying direction, the upper guide device deforming the fingers into a sheet stacking position adjacent the sheet stacking tray; and a lower guide device located downstream of the sheet stacking tray in the conveying direction, the lower guide device guiding the fingers to flip from the sheet stacking position into a sheet receiving position adjacent the printed sheet receiving tray means.

20. The ink jet printing apparatus of claim 19, wherein said fingers are cantilevered from said endless conveying device.

21. The ink jet printing apparatus of claim 20, wherein said fingers are secured to said endless conveying device in a longitudinally spaced arrangement.

* * * * *